United States Patent [19]

Bell

[11] Patent Number: 4,982,672

[45] **Date of Patent: * Jan. 8, 1991**

[54] LOW NOX INCINERATION PROCESS

[75] Inventor: Ronald D. Bell, Austin, Tex.

[73] Assignee: Radian Corporation, Austin, Tex.

[ * ] Notice: The portion of the term of this patent subsequent to Mar. 14, 2006 has been disclaimed.

[21] Appl. No.: 488,376

[22] Filed: Feb. 23, 1990

Related U.S. Application Data

[63] Continuation of Ser. No. 252,681, Oct. 3, 1988, abandoned, which is a continuation-in-part of Ser. No. 122,067, Nov. 18, 1987, Pat. No. 4,811,555.

[51] Int. Cl.[5] ..... F23G 7/06

[52] U.S. Cl. ..... 110/346; 110/213; 110/214; 110/212

[58] Field of Search ..... 110/345, 210–214, 110/346

[56] References Cited

U.S. PATENT DOCUMENTS

| | | | |
|---|---|---|---|
| 3,472,498 | 10/1969 | Price et al. | 110/212 |
| 3,780,674 | 12/1973 | Liu | 110/212 |
| 3,996,862 | 12/1976 | Besik et al. | 110/212 |
| 4,013,023 | 3/1977 | Lombana et al. | 110/212 |
| 4,038,032 | 7/1977 | Brewer et al. | 110/212 |
| 4,213,403 | 7/1980 | Gomori | 110/214 |
| 4,458,662 | 7/1984 | Barnett | 110/214 |
| 4,475,472 | 10/1984 | Adrian et al. | 110/214 |
| 4,483,258 | 11/1984 | John et al. | 110/213 |
| 4,784,069 | 11/1988 | Stark | 110/212 |
| 4,811,555 | 3/1989 | Bell | 60/39.06 |

*Primary Examiner*—Henry C. Yuen

*Attorney, Agent, or Firm*—Klauber & Jackson

[57] ABSTRACT

A process for low NOX incineration which involves incinerating hazardous waste to produce a gaseous stream, adding combustible material to produce a combustible gas stream having combustible material in excess of the oxygen in the combustible gas stream, incinerating the combustible gas stream in a reducing atmosphere to produce a heated oxygen-depleted gaseous stream, converting at least a portion of the heat in the oxygen depleted stream into steam, adding air to the oxygen depleted stream to produce a stoichiometric excess of oxygen in the resultant stream relative to combustible material present in the resultant stream, passing the resultant stream over an oxidizing catalyst to produce an oxidized gaseous stream, removing heat from the oxidized stream, and venting the resultant cooled stream. A system for carrying out the foregoing process is also provided.

10 Claims, 1 Drawing Sheet

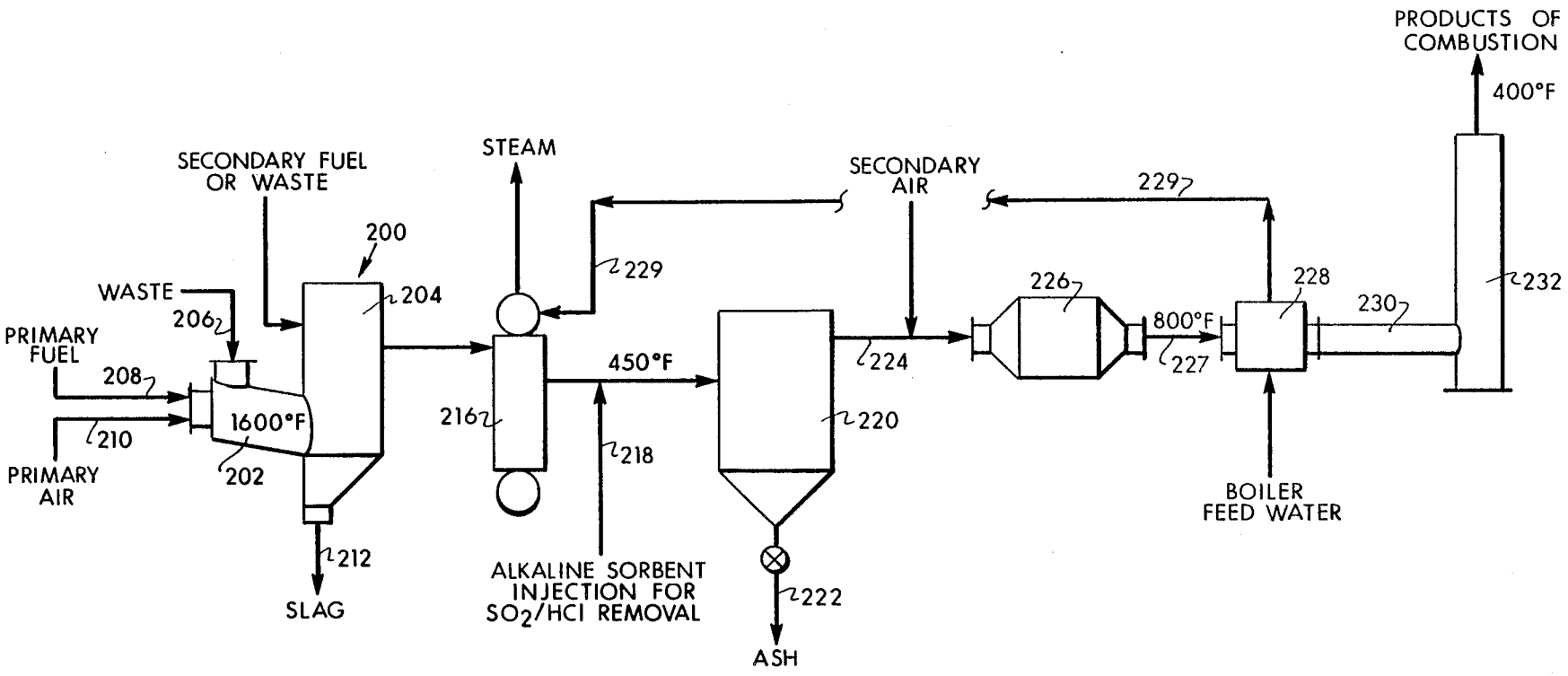
PRODUCTS OF COMBUSTION
400°F
232
230
228
BOILER FEED WATER
229
800°F
227
226
SECONDARY AIR
224
220
222
ASH
229
450°F
218
ALKALINE SORBENT INJECTION FOR SO2/HCl REMOVAL
STEAM
216
200
204
212
SLAG
SECONDARY FUEL OR WASTE
1600°F
202
WASTE
206
208
210
PRIMARY FUEL
PRIMARY AIR

LOW NOX INCINERATION PROCESS

REFERENCE TO RELATED APPLICATION

This is a continuation of application Ser. No. 252,681, filed Oct. 3, 1988, now abandoned, which was a continuation-in-part of Ser. No. 122,067, filed Nov. 18, 1987, now U.S. Pat. No. 4,811,555.

FIELD OF THE INVENTION

This invention relates to ensuring low NOX content of products of combustion and is more particularly concerned with a hazardous waste incineration process which ensures low NOX content of the evolved gases.

BACKGROUND OF THE INVENTION

Many combustion processes generate effluent gases having an unacceptable NOX content. Thus, oxides of nitrogen are one of the principal contaminants emitted by combustion processes. In every combustion process, the high temperatures at the burner result in the fixation of some oxides of nitrogen. These compounds are found in stack gases mainly as nitric oxide (NO) with lesser amounts of nitrogen dioxide ($NO_2$) and only traces of other oxides. Since nitric oxide (NO) continues to oxidize to nitrogen dioxide ($NO_2$) in the air at ordinary temperatures, there is no way to predict with accuracy the amounts of each separately in vented gases at a given time. Thus, the total amount of nitric oxide (NO) plus nitrogen dioxide ($NO_2$) in a sample is determined and referred to as "oxides of nitrogen (NOX).

Oxides of nitrogen emissions from stack gases, through atmospheric reactions, produce "smog" that stings eyes and causes acid rains. For these reasons, the content of oxides of nitrogen present in gases vented to the atmosphere is severely limited by various state and federal agencies. To meet the regulations for NOX emissions, several methods of NOX control have been employed. These can be classified as either equipment modification or injection methods. Injection methods include injection of either water or steam to lower the temperature since the amount of NOX formed generally increases with increasing temperatures, or injection of ammonia to selectively reduce NOX. Water or steam injection, however, adversely affects the overall fuel efficiency of the process. A process involving the injection of ammonia into the products of combustion is shown, for example, in Welty, U.S. 4,164,546. Examples of processes utilizing ammonia injection and a reducing catalyst are disclosed in Sakari et al, U.S. 4,106,286; and Haeflich, U.S. 4,572,110. Selective reduction methods using ammonia injection are expensive and somewhat difficult to control. Thus, these methods have the inherent problem of requiring that the ammonia injection be carefully controlled so as not to inject too much and create a possible emission problem by emitting excess levels of ammonia. In addition the temperature necessary for the reduction of the oxides of nitrogen must be carefully controlled to get the required reaction rates.

Equipment modifications include modifications to the burner or firebox to reduce the formation of NOX. Although these methods do reduce the level of NOX, each has its own drawbacks. A selective catalytic reduction system is presently considered by some authorities to be the best available control technology for the reduction of NOX. Currently available selective catalytic reduction systems used for the reduction of NOX employ ammonia injection into the exhaust gas stream for reaction with the NOX in the presence of a catalyst to produce nitrogen and water vapor. Such systems typically have an efficiency of 80–90 percent when the gas stream is at temperature within a temperature range of approximately 600° -700° F. The NOX reduction efficiency of the system will be significantly less if the temperature is outside the stated temperature range and the catalyst may be damaged at higher temperatures. As Applicant Bell has disclosed in Mc Gill et al 4,405,587, of which he is a co-patentee, oxides of nitrogen can be reduced by reaction in a reducing atmosphere such as disclosed in that patent at temperatures in excess of 2000° F.

An important source of NOX emissions is the incineration of hazardous wastes. Such incineration can be carried out in incinerators wherein the waste is combusted in a primary combustion zone followed by a secondary combustion zone Excessive NOX emissions from such combustion are a serious environmental problem and various efforts to suppress them, such as the techniques referred to above, have been attempted, with varying results.

It is, accordingly, an object of this invention to provide an improved method involving incineration which brings about effective lowering of NOX in the incineration emissions.

It is another object of the invention to provide a system for hazardous waste incineration wherein emissions will have significantly lowered NOX levels.

BRIEF SUMMARY OF THE INVENTION

In accordance with the invention, in a process involving combustion which normally produces unacceptable NOX emissions more particularly a hazardous waste incineration process, there is provided an oxygen-rich primary combustion followed by a fuel-rich secondary combustion involving reducing gaseous conditions and providing an oxygen deficient gaseous effluent. The secondary combustion effluent is used to generate steam and the effluent has $SO_2$, HCl and ash removed from it. Air is then added to the gaseous effluent to form a lean fuel-air mixture, and this mixture is passed over an oxidizing catalyst, with the resultant gas stream then passing to an economizer or low pressure waste heat boiler for substantial recovery of its remaining heat content, and the gas, now meeting NOX emission standards, is thereafter vented to the atmosphere. The apparatus system of the invention particularly suited for carrying out the above-described process a system for low NOX hazardous waste incineration comprises a two-stage incinerator defining a first combustion zone and a secondary combustion zone, means for adding fuel to the secondary combustion zone to produce a reducing atmosphere therein, means for converting to steam at least a portion of the heat in the effluent from the secondary combustion zone, means for adding alkaline adsorbents to that effluent, a bag house downstream of the alkaline-adsorbent addition means, means for adding air to the effluent from the bag house, an oxidizing catalyst-containing reaction chamber to receive the air-enriched effluent, heat recovery means for removing heat from the effluent from the reaction chamber, and a vent for removal of the final effluent.

BRIEF DESCRIPTION OF THE DRAWING

The figure of the drawing is a diagrammatic flow sheet of a hazardous waste combustion system embodying features of the present invention.

DETAILED DESCRIPTION OF PREFERRED EMBODIMENTS

Referring now to the figure of the drawing, there is shown an illustrative embodiment of the invention involving a hazardous waste incinerator. In the drawing, the reference numeral 200 designates a hazardous waste incinerator comprising a primary combustion chamber 202 and a secondary combustion chamber 204. Waste to be incinerated is supplied through charge inlet 206, whereas fuel, e.g. gas, such as natural gas, is supplied through line 208, and combustion air is supplied through line 210. The primary combustion chamber is suitably in the form of a rotary kiln to accommodate solid hazardous waste, but liquid and gaseous waste can also be handled. When liquid waste is charged it suitably is atomized to ensure efficient combustion. Primary combustion of the waste takes place in the primary combustion chamber or zone 202. Combustion generally occurs at a temperature of 1500° to 2000° F. Should there be any ash and/or noncombustible materials in the waste incinerated in the primary combustion zone 202, generally characterized as "slag", it is discharged by gravity through bottom outlet 212. In the primary combustion chamber, combustion takes place in an oxygen-rich atmosphere, i.e., the amount of oxygen in the air supplied is in stoichiometric excess with respect to combustible materials provided by the fuel and the waste being incinerated. Consequently, the effluent gas from the primary combustion chamber or zone 202 as it enters secondary combustion chamber or zone 204 also has excess oxygen with respect to any combustible material in it. In the secondary zone, however, additional fuel and, optionally, additional liquid or gaseous waste are added to the effluent gases from the primary zone in amounts such that combustible material in the form of waste and/or fuel is now in stoichiometric excess with respect to available oxygen, e.g., 10 to 25% excess, and combustion takes place in the secondary combustion zone 204 under reducing conditions, generally at about 2200° to 2600° F. A residence time of 0.5 second is required. A greater residence time can be employed, e.g., 1 second or more, but serves no useful purpose.

The hot effluent from the secondary combustion zone 204 of the incinerator is fed to a boiler 216 wherein heat in the effluent is used to generate steam, and the temperature of the hot effluent is reduced to about to 400° to 550° F., typically about 450° F. In order to protect the downstream catalyst bed, which will be described below, against fouling and possible deactivation, it is important that any $SO_2$, and HCl and like acidic materials be removed from the gas before it reaches the catalyst. Removal of $SO_2$ HCl, and the like, from the gas is achieved by means of an alkaline absorbent, e.g., sodium carbonate, sodium bicarbonate, sodium hydroxide, calcium carbonate, and the like, either in dry form or as an aqueous solution or suspension, or other means, introduced through inlet 218. Removal of these corrosive substances is important not only to protect the catalyst but in order to protect the downstream equipment itself against damage. The effluent gas from the incinerator may also carry along some ash and other solid particles. These solid materials are suitably separated from the gas in any convenient manner, e.g., by passing the gas through a bag house 220, the separated ash, and the like, being removed through drain line 222. At this point, the effluent gas stream is still oxygen deficient in terms of the stoichiometric relationship between its content of oxygen and combustible material, e.g., fuel. Thereupon, it is passed into conduit 224.

The gas is, however, low in NOX and the treatment of the gases flowing through the system has brought about a reduction of any NOX formed, or a suppression of the formation of the NOX, without the use of ammonia or like treatment widely used in the prior art. In order, however, to utilize to the maximum the heat potential of the gas and any fuel which it may contain, air is added to the stream in conduit 224 and the resulting gaseous stream is passed to a gas-treatment unit 226 wherein the gas stream is passed over an oxidizing catalyst. The air is added in an amount relative to the stream in conduit 224 such that the resulting stream will contain oxygen stoichiometrically in excess of the amount needed to burn any fuel or other combustible material which may be present in the stream, e.g., 10% to 50% excess. Thus, products at approximately the boiler discharge temperature, e.g., 450° F. are mixed with air and passed over an oxidizing catalyst.

Either noble metal oxidizing catalysts such as platinum or palladium, or base metal oxides, such as copper oxide, chrome oxide, or manganese oxide, or the like, may be used for this purpose. The noble metal oxidizing catalysts, e.g., platinum or palladium catalysts, are most suitably the noble metals deposited in the zero valent state upon a support, such as alumina, silica, kiesel-guhr, or a metal alloy, and the like. The metal oxide catalysts are also most suitably the metal oxides supported on supports of this character. The making of such catalysts is well known to persons skilled in the art. Catalyst volumes will vary depending on the particular catalyst used. Ordinarily, the quantity of catalyst and the flow rate are such that the space velocity is typically in the range of 30,000 to 50,000 $hr.^{-1}$.

Data indicate that NOX levels in the parts per billion range can be realized by the combined reduction-oxidation operations of this invention. The oxidized gaseous effluent from the unit 226 passes into a conduit 227 which leads to an economizer or a low-pressure, waste heat boiler, or the like, indicated at 228, and the heat content of the oxidized gaseous effluent is extracted to the maximum amount economically feasible. As seen in the drawing, the boiler feed water, which is first passed in indirect heat-exchange relationship through economizer 228, is heated by heat exchange with the gas and is passed via line 229 to boiler 216. The cooled gas at a temperature of about 300° to 400° F. is then discharged through an outlet conduit 230 into a stack 232 and vented to the atmosphere with the assurance that the vented effluent will comply with NOX emission standards. It will have a NOX content of less than 50 ppm.

It will, of course, be understood that in the foregoing description of the drawing, reference to an incinerator, boiler, waste-heat boiler, economizer, gas treatment unit, and the like, contemplates the use of standard equipment well known to persons skilled in the art. The gas treatment unit, for example, can be any container adapted for gas passage and containing an oxidizing catalyst.

Minimizing the formation of oxides of nitrogen in combustion, in accordance with the invention, offers several advantages over the current state of the art. This process does not require that a potentially obnoxious gas, such as ammonia, be injected into the system; the reaction conditions do not require that a narrowly-controlled temperature be maintained for the reduction of oxides of nitrogen to occur; the operating conditions are compatible with conventional incineration conditions; and greater NOX reduction efficiencies can be achieved.

The following example will serve more fully to illustrate the features of the invention.

In a typical operation, the primary combustion zone of an incinerator is fed with solid or liquid hazardous waste, auxiliary fuel, and air to produce a combustible mixture which is combusted at a temperature of 1500°-2000° F. to produce a stream of combustion products. The effluent stream from the primary combustion zone at a temperature of about 1500°-2000° F. contains about 4% oxygen. Auxiliary fuel or more liquid waste at ambient temperature is injected into this stream to give the resultant stream a fuel content such that the combustible content is 10% in stoichiometric excess relative to the oxygen present. The resultant stream is then incinerated in the secondary incineration zone at a temperature of about 2000°-2400° F. and, since the combustible material is in Heat present in the combustion products is at least partially converted into steam by heat exchange with water, e.g., in boiler tubes, and the resulting gaseous stream, which is of course, oxygen depleted, has a temperature of about 450° F. To this oxygen-depleted stream is then added an aqueous solution of sodium carbonate or similar alkaline reagent sufficient to react with the acidic components of the stream, expressed as $SO_2$ and HCl, and the stream is passed through a bag house to separate solid components. Air at ambient temperature is then added to the stream in an amount such that the resultant stream has an oxygen content which is 10-50% stoichiometrically in excess relative to any combustible material present in the oxygen-depleted stream to which the air is added. The resultant oxygen-rich stream is then fed through a bed containing a noble metal, e.g., platinum or palladium, supported on alumina, with a space velocity of 30,000-50,000 hr.$^{-1}$. At this point the gaseous stream being processed has a temperature of about 450° F. This temperature increases across the catalyst bed to about 800° F. Heat is then extracted by appropriate heat exchange to leave a final stream to be vented having a temperature of about 400° F. and a NOX content of less than 50 ppm.

It will be understood that various changes and modifications may be made without departing from the invention as defined in the appended claims and it is intended, therefore, that all matter contained in the foregoing description and in the drawing shall be interpreted as illustrative only and not in a limiting sense.

What is claimed is:

1. A process for low $NO_x$ hazardous waste incineration which comprises incinerating hazardous waste in the presence of air and fuel in a primary incineration zone to produce a first effluent gas stream, the amount of air supplied to said primary zone being in stoichiometric excess with respect to combustible materials provided by the fuel and waste being incinerated, whereby said first effluent gas stream also has excess oxygen with respect to combustible material therein; adding combustible materials to said first effluent gas stream to provide a combustible gas stream having a combustible material content in excess of the oxygen in said combustible gas stream and incinerating said combustible gas stream in a secondary incineration zone at a temperature in the range of 2000° to 2400° F. and under the reducing conditions arising from said excess combustible material content, to produce a heated oxygen-depleted gaseous effluent stream; converting at least a portion of the heat in said oxygen-depleted stream into steam, thereby cooling said stream; adding air to said cooled oxygen-depleted stream to produce a stoichiometric excess of oxygen in the resultant stream relative to combustible material present in said resultant stream and passing said resultant stream over an oxidizing catalyst to produce an oxidized gaseous stream; removing heat from said oxidized stream, and venting the resultant cooled stream of low $NO_x$ content.

2. A process as defined in claim 1, wherein said hazardous waste is incinerated in said first incineration zone at a temperature of 1500°-2000° F.

3. A process as defined in claim 1, wherein said oxygen-depleted stream is cooled to a temperature of about 450° F. during said conversion of the heat to steam.

4. A process as defined in claim 1, wherein the space velocity of said resultant stream passing over said oxidizing catalyst is about 30,000 to 50,000 hr.$^{-1}$.

5. A process as defined in claim 1, wherein said air is added to said oxygen-depleted stream in an amount to provide a stoichiometric excess of oxygen present in the resultant stream of 10 to 50%.

6. A process as defined in claim 1, wherein the cooled gas vented to the atmosphere is at a temperature of about 300° to 400° F.

7. A process as defined in claim 1, wherein the cooled gas vented to the atmosphere has a NOX content of less than 50ppm.

8. A process as defined in claim 1, wherein the oxygen-depleted gaseous stream is treated to remove acidic components therefrom;

9. A process as defined in claim 1, wherein the oxygen-depleted gaseous stream is treated to remove solid components therefrom.

10. A process as defined in claim 1, wherein the oxygen-depleted gaseous stream is treated to remove acidic components therefrom, and wherein the oxygen-depleted gaseous stream is treated to remove solid components therefrom.

* * * * *